US009941036B2

(12) United States Patent
Morico et al.

(10) Patent No.: US 9,941,036 B2
(45) Date of Patent: Apr. 10, 2018

(54) MODULAR, HIGH DENSITY, LOW INDUCTANCE, MEDIA COOLED RESISTOR

(71) Applicant: Raytheon Company, Waltham, MA (US)

(72) Inventors: Peter D. Morico, North Grafton, MA (US); Bradley S. Jaworski, Bedford, MA (US)

(73) Assignee: RAYTHEON COMPANY, Waltham, MA (US)

( * ) Notice: Subject to any disclaimer, the term of this patent is extended or adjusted under 35 U.S.C. 154(b) by 102 days.

(21) Appl. No.: 15/013,768

(22) Filed: Feb. 2, 2016

(65) Prior Publication Data

US 2017/0221610 A1 Aug. 3, 2017

(51) Int. Cl.
*H01C 1/082* (2006.01)
*H01C 13/02* (2006.01)

(52) U.S. Cl.
CPC ..... *H01C 1/082* (2013.01); *H01C 13/02* (2013.01)

(58) Field of Classification Search
CPC ..... H01C 1/082; H01C 13/02
USPC ..... 338/53
See application file for complete search history.

(56) References Cited

U.S. PATENT DOCUMENTS 5,353,005 A 10/1994 Salanki
5,877,674 A * 3/1999 Berger, II ..... H01C 3/10 338/280
6,101,715 A * 8/2000 Fuesser ..... H01C 1/082 165/104.33
7,200,007 B2 4/2007 Yasui et al.
7,360,582 B2 4/2008 Olesen
8,643,464 B2 2/2014 Nazzaro
2012/0126933 A1* 5/2012 Qiu ..... H01C 1/082 338/53
2014/0055228 A1* 2/2014 Wang ..... H01C 17/006 338/311

FOREIGN PATENT DOCUMENTS

DE 4112677 * 10/1992 ..... H01C 1/082
DE 4112677 A1 10/1992
DE 19514548 C1 10/1996

OTHER PUBLICATIONS

International Search Report dated May 16, 2017 in connection with International Patent Application No. PCT/US2017/016015.

(Continued)

*Primary Examiner* — Kyung Lee
*Assistant Examiner* — Iman Malakooti

(57) ABSTRACT

A resistor includes a first resistor element. The first resistor element is connected to at least a first electrical terminal and a second electrical terminal. The first resistor element is configured to directly contact cooling media on at least two surfaces of the first resistor element in order to transfer heat away from the first resistor element. The resistor may also include a second resistor element connected to at least the first electrical terminal and the second electrical terminal, where the second resistor element is configured to directly contact the cooling media on at least two surfaces of the second resistor element in order to transfer heat away from the second resistor element.

20 Claims, 4 Drawing Sheets

(56) References Cited

OTHER PUBLICATIONS

Written Opinion of the International Searching Authority dated May 16, 2017 in connection with International Patent Application No. PCT/US2017/016015.
"Power Resistor for Mounting onto a Heatsink Thick Film Technology", Vishay, Oct. 24, 2013, 5 pages.
"Water-Cooled Wirebound Resistor", Vishay, Oct. 24, 2013, 2 pages.
"Water-Cooled Resistors", Kanthal Globar, 1 page.

* cited by examiner

MODULAR, HIGH DENSITY, LOW INDUCTANCE, MEDIA COOLED RESISTOR

TECHNICAL FIELD

The present disclosure is directed in general to the use of resistors, a subset of which is for power applications. Resistors of this nature are commonly referred to as power resistors. More specifically, this disclosure relates to a modular, high density, low inductance, media cooled double-sided power resistor.

BACKGROUND OF THE DISCLOSURE

Various power resistors typically include a resistor element. In many cases, the resistor element is decoupled from the cooling method, whether it be conduction, convection, radiation, or impingement cooling, with impingement cooling being a specialized form of conduction cooling. Heat transfer away from the resistor is maximized when the maximum amount of resistor power dissipating element area is in direct contact with the cooling media. A less than majority of the resistor element surface area can be utilized for heat transfer. Power resistors can also include a plurality of resistor elements aligned in series as well as aligned in parallel.

SUMMARY

To address one or more deficiencies of the prior art, one embodiment described in this disclosure provides a power resistor utilizing at least one power element that facilitates heat transfer using at least two surfaces of the power element.

In a first example, a resistor is provided. The resistor includes a first resistor element. The first resistor element is connected to at least a first electrical terminal and a second electrical terminal. The first resistor element is configured to directly contact cooling media on at least two surfaces of the first resistor element in order to transfer heat away from the first resistor element.

In a second example, a resistor system is provided. The resistor system includes a resistor and a manifold. The manifold is configured to house the resistor and provide cooling media for communication through the resistor. The resistor includes a first resistor element connected to at least a first electrical terminal and a second electrical terminal. The first resistor element is configured to directly contact the cooling media on at least two surfaces of the first resistor element in order to transfer heat away from the first resistor element.

In a third example, a method is provided. The method includes receiving cooling media by an inlet of a channel of a resistor. The channel is between a first electrical terminal and a second electrical terminal of the resistor. The method also includes permitting direct contact between the cooling media and at least a first surface and a second surface of a first resistor element of the resistor. The first resistor element is connected to at least the first electrical terminal and the second electrical terminal. The method further includes communicating the cooling media to an outlet of the channel of the resistor after permitting the direct contact between the cooling media and at least the first surface and the second surface of the first resistor element of the resistor.

Although specific advantages have been enumerated above, various embodiments may include some, none, or all of the enumerated advantages. Additionally, other technical advantages may become readily apparent to one of ordinary skill in the art after review of the following figures and description.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

It should be understood at the outset that, although example embodiments are illustrated below, the present invention may be implemented using any number of techniques, whether currently known or not. The present invention should in no way be limited to the example implementations, drawings, and techniques illustrated below. Additionally, the drawings are not necessarily drawn to scale.

A resistor is a passive two-terminal electrical component that implements electrical resistance as a circuit element. Resistors act to reduce current flow and, at the same time, act to lower voltage levels within circuits. Heat is also transferred from the circuit to the resistors in accordance with Ohms law. In terms of current, power dissipation measured in watts in a resistor is calculated as the square of the current in amperes through the resistor multiplied by the resistor value in ohms. The resistor heat can be transferred to ambient media surrounding, passing over, or passing across the resistor. Media can include, for example, liquid refrigerants, oils, isotropic materials, molten waxes, molten metals, alcohol-based fluids, gases such as hydrogen ($H_2$) and sulfur hexafluoride ($SF_6$), air, or the like. High-power resistors, also referred to here as "power resistors," can dissipate hundreds or thousands of watts of electrical power as heat and can be used as a part of motor controls, in power distribution systems, or as test loads for generators. Industrial applications for power resistors include overhead cranes, locomotives, lift trucks, elevators, conveyors, battery lines/chargers, plating baths, power supplies, industrial controls, arc and spot welders, alternating current (AC) variable frequency drives and direct current (DC) drives, smelting, dynamic braking, mining, electrical energy generation, distribution, and transmission, harmonic filtering, current sensing, neutral grounding, load banks, mining applications, shunt regulators, dynamic loads, traction braking, damping, load shed/thump protection or avoidance, airborne, ground and mobile radars, radio frequency (RF) loads, transient load diverters for generator sets, or the like.

Figure 1:
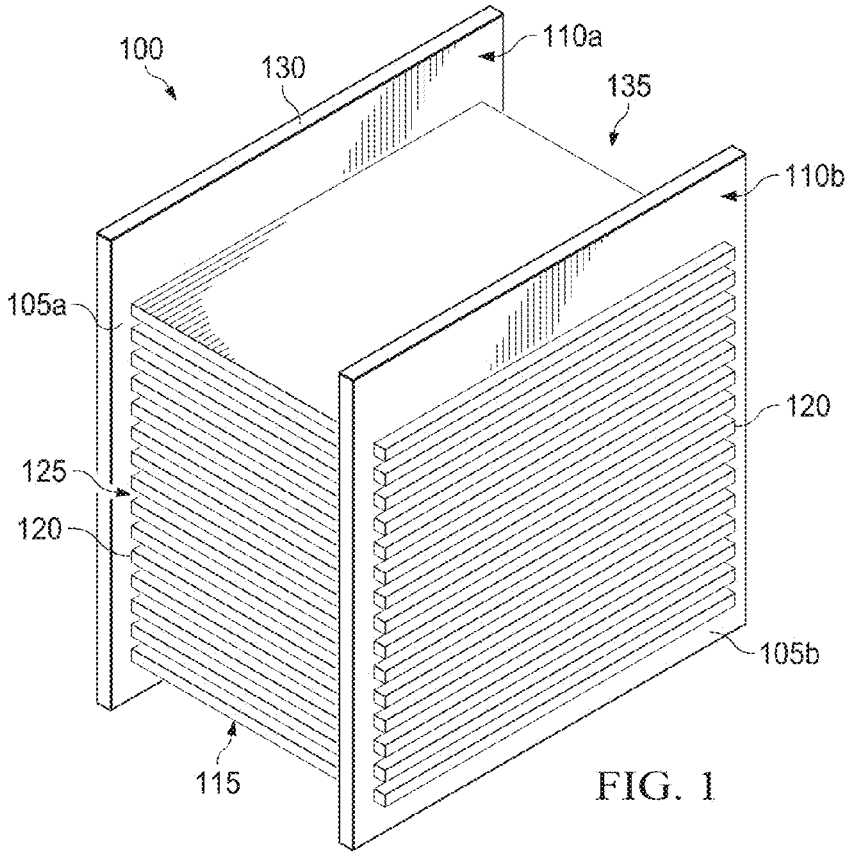
FIG. 1 illustrates an example power resistor according to this disclosure.

FIG. 1 illustrates an example power resistor 100 according to this disclosure. As shown in FIG. 1, the power resistor 100 includes at least two terminals 105*a* and 105*b*. The terminals 105*a* and 105*b* can be tin or lead-tin plated copper terminals, for example. Terminal 105*a* includes a first electrical connection 110*a*. Terminal 105*b* includes a second electrical connection 110*b*. As shown in FIG. 1, the first electrical connection 110*a* and the second electrical connection 110*b* extend longitudinally from the terminals 105*a* and 105*b*, respectively, and are configured to connect to an electrically conductive channel (not shown in FIG. 1), receive electrical current from the electrically conductive channel, and distribute electrical current to the electrically conductive channel.

The power resistor 100 also includes one or more resistor elements 115 connected to the terminals 105*a* and 105*b* at connection points 120. The resistor elements 115 can be soldered, welded, bonded, press-fit, or fastened in any manner that provides an electrical conduction path to each of the terminals 105*a* and 105*b* or connected in an alternative manner. The resistor elements 115 are connected to the terminals 105*a* and 105*b* so that at least two surfaces of each of the resistor elements 115 can directly contact fluid or other media moving between the terminals 105*a* and 105*b*.

For example, as shown in FIG. 1, at least two surfaces of a resistor element 115 are disposed on opposing sides of the resistor element 115. It should also be noted that each of the at least two surfaces of the resistor element 115 has the largest surface area among surfaces of the resistor element 115. In other words, a resistor element 115 can have a plate-like configuration so that the surfaces of the resistor element 115 with the largest surface areas are on opposite or opposing sides of the resistor element 115 from each other. As electrical current is received by a terminal (such as terminal 105*a*) via an electrical connection (such as the first electrical connection 110*a*) and is communicated to the resistor elements 115, a voltage drop forms across each of the resistor elements 115 and heat is generated. Fluid or other cooling media in direct contact with the at least two surfaces of each of the resistor elements 115 transfers heat via impingement, conduction, convection, and/or radiation from each of the resistor elements 115 to the fluid or other cooling media. It should be noted that in some embodiments, other surfaces (such as edges) of a resistor element 115 that are soldered or fastened to the terminals 105*a* and 105*b* forming electrical connections between the terminals 105*a* and 105*b* and the resistor element 115, for example, may not be in direct contact with fluid or other cooling media to transfer heat via impingement.

As an example, the first electrical connection 110*a* can be coupled to an electrically conductive channel and can receive electrical current. The electrical current can be channeled from the first electrical connection 110*a*, through the first terminal 105*a*, and to the resistor elements 115 via connection points 120. A voltage drop occurs across each of the resistor elements 115 and heat is generated. Fluid or other cooling media is received via an inlet 125 to a media channel 130 to permit media flow over at least two surfaces of the resistor elements 115. The heat generated on the at least two surfaces of the resistor elements 115 due to the voltage drop is transferred to the media while the media is in direct contact with the at least two surfaces of the resistor elements 115. After the media flows over the at least two surfaces of the resistor elements 115, the media leaves the media channel 130 via an outlet 135. The media communication through the channel 130 can include laminar flow, turbulent flow, or both. The media channel 130 can include the cavity space retaining the one or more resistor elements 115. The inlet 125 can be defined as a media portal permitting media to pass into the channel 130, and the outlet 135 can be defined as a media portal permitting media to pass out of the channel 130.

The power resistor 100 (such as a high density, media cooled power resistor) provides as much as twenty (20) times or more the amount of power dissipation density in mounting surface area over other power resistors. The power resistor 100 combines cross-flow multi-plate features of flat plate heat exchangers with the robustness, simplicity, and low cost of film that include, for example, ruthenium (IV) oxide ($RuO_2$). The power resistor 100 also includes inherently low manufacturing costs, low inductance (due to electric current travelling across a wide conductor, a film in this example, as well as through parallel paths), and high operating temperature capability and high reliability. By stacking resistor elements in a parallel or series orientation within the media channel 130, the power resistor 100 achieves high power density with minimal footprint. In contrast, other power resistors, due to configurations of the resistor elements, have lower surface-to-mass or surface-to-volume ratios, thus making heat dissipation more difficult are not thermally modular by design. For example, cylindrical resistor elements have a larger mass relative to their surface area, slowing heat dissipation, and do not lend themselves to be packaged together to realize a smaller mounting surface area than as a group.

Figure 4:
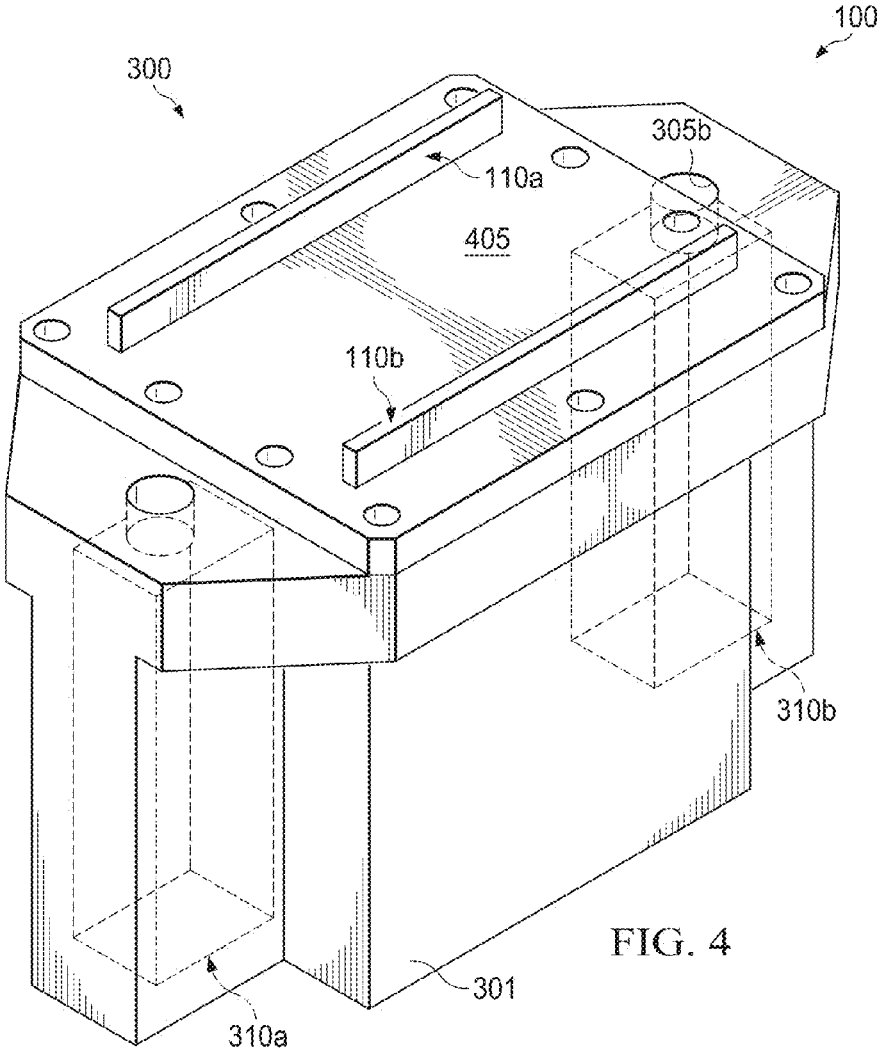

The power resistor 100 also permits heat dissipation over at least two surfaces of the resistor elements 115 to equalize stress on the conducting elements, thereby enabling high energy/power dynamic pulse load handling capability while doubling the power density. The power resistor 100 also facilitates direct contact or direct impingement between the at least two surfaces of the resistor elements 115 to maximize heat removal potential. Furthermore, as discussed herein, a substrate supporting the film can be made hollow, providing additional surface area for coolant fluid or other media to contact. The surfaces can include conducting elements such as films or serpentine wire shapes. The conducting elements can include $RuO_2$, iron, tungsten, copper, silver, oxides, conductors, alloys, unary, binary, ternary or quaternary semiconductor compound materials, or the like. Furthermore, two or more resistor elements 115 aligned in parallel provide parallel heat transfer (such as cooling) of the resistor elements 115 at the same time while minimizing pressure drop across the power resistor 100. The power resistor 100 can be made using a variety of manufacturing techniques including three-dimensional (3D) printing realizing an integrated final or nearly final assembly all in one step as shown in FIG. 4.

Although FIG. 1 illustrates an example of a power resistor 100, various changes may be made to FIG. 1. For example, the makeup and arrangement of the power resistor 100 are for illustration only. Components could be added, omitted, combined, or placed in any other configuration according to particular needs.

Figure 2:
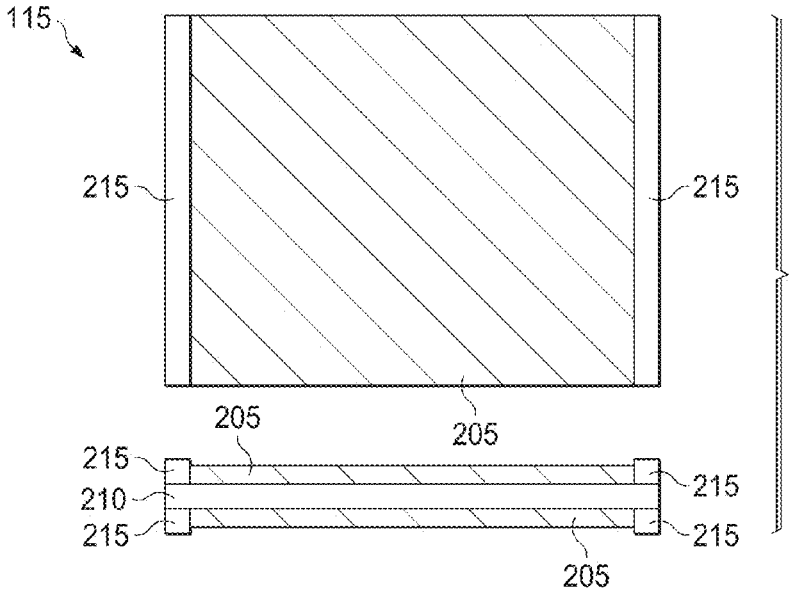
FIG. 2 illustrates top and end views of an example resistor element according to this disclosure.

FIG. 2 illustrates top and end views of an example resistor element 115 according to this disclosure. The resistor element 115 includes conducting elements 205 (such as films or serpentine or other patterned conductive materials) that are deposited on at least two surfaces of the resistor element 115. The conductive elements 205 can include, for example, $RuO_2$, iron, tungsten, copper, silver, oxides, conductors, alloys, unary, binary, ternary or quaternary semiconductor compound materials, or the like. The resistor element 115 also includes terminations 215 that electrically connect the conductive elements 205 to terminals 105*a* and 105*b* as shown in FIG. 1. The terminations 215 transmit current to and from the conductive elements 205. The conductive elements 205 are separated by a substrate 210. The substrate 210 can include alumina, ceramic material, or the like. The substrate 210 can be hollow for additional cooling surface area exposure to the cooling media.

Although FIG. 2 illustrates an example of a resistor element 115, various changes may be made to FIG. 2. For example, components could be added, omitted, combined, or placed in any other configuration according to particular needs.

Figure 3:
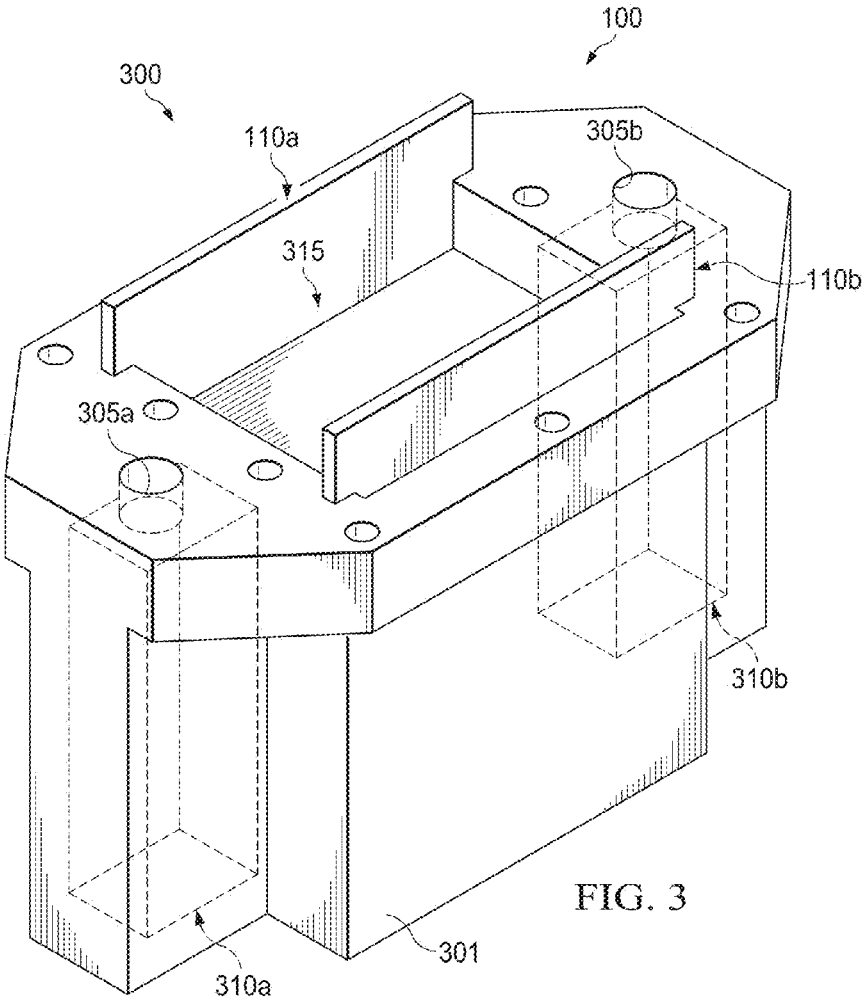
FIGS. 3 and 4 illustrate example power resistor systems according to this disclosure.

FIG. 3 illustrates an example power resistor system 300 according to this disclosure. The power resistor system 300 includes a power resistor 100 (as shown in FIG. 1) and a manifold 301 to house the power resistor 100. The manifold 301 includes a first cavity 310*a* and a second cavity 310*b*. The first cavity 310*a* is configured to receive fluid or other cooling media via an inlet port 305*a* and transmit the media to the media channel 130 (shown in FIG. 1). The second cavity 310*b* is configured to receive the media from the media channel 130, for example after heat transfer occurs between at least one resistor element 115 and the media, and communicate the media through an outlet port 305*b*. An opening 315 allows the first electrical connection 110*a* and the second electrical connection 110*b* to extend outward beyond an external surface of the manifold 301 to connect with an electrical conductive material to receive electrical current.

Furthermore, as shown in FIG. 4, a cap 405 can be positioned over the opening 315 to seal or close the opening 315 while still permitting the electrical connections 110*a*-110*b* to extend from the manifold 301. For example, the cap 405 can include indentations, grooves, or openings that permit the electrical connections 110*a*-110*b* to extend through the cap 405 while the manifold 301 retains a pressure within. A seal can be formed between the electrical connections 110*a*-110*b*, the manifold 301, and the cap 405. The seal can be formed by soldering, brazing, pressure fitting, an epoxy conductive adhesive, or the like.

Figure 5:
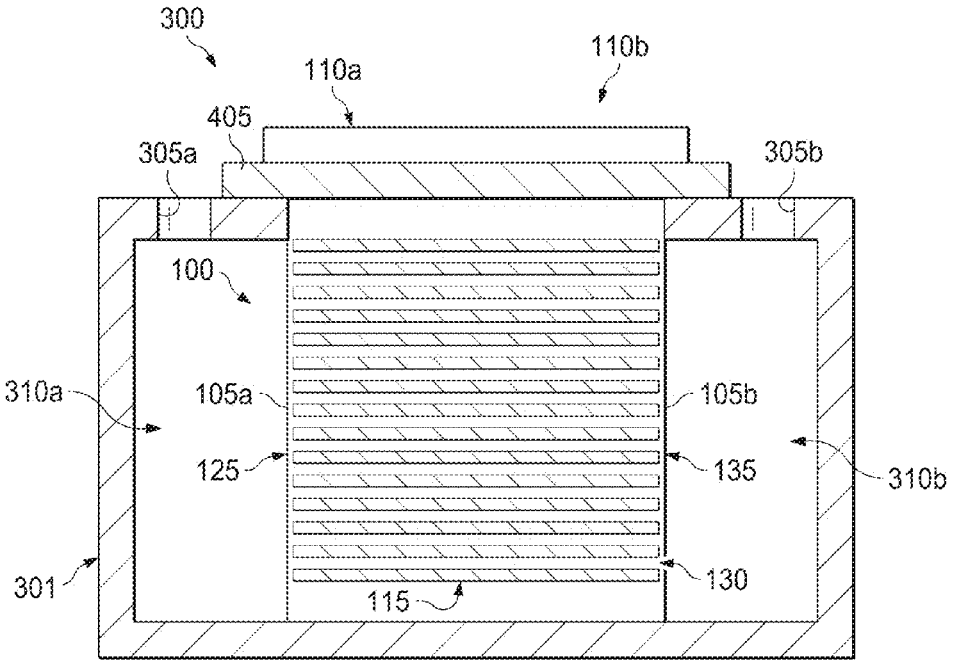
FIG. 5 illustrates a cross-section of the power resistor system of FIGS. 3 and 4 according to this disclosure.

FIG. 5 illustrates a cross-section of the power resistor system 300 of FIGS. 3 and 4 according to this disclosure. As shown in FIG. 5, the power resistor system 300 permits fluid or other cooling media to enter the manifold 301 via the inlet port 305*a* and into the first cavity 310*a*. Multiple inlets and outlets are also possible. The media is permitted to travel through the inlet 125 to the media channel 130 where the media directly contacts one or more resistor elements 115 on at least two surfaces. After the media directly contacts the one or more resistor elements 115 on the at least two surfaces, the media travels through the media channel 130 and out the outlet 135 into the second cavity 310*b*. Subsequently, the media travels from the second cavity 310*b* through the outlet port 305*b*, exiting the manifold 301. It should be understood that a pressure generating device (such as a pump) can feed the media via a supply into the first cavity 310*a* through the inlet port 305*a*, as well as feed the media from the second cavity 310*b* into a return via the outlet port 305*b*. In some embodiments, the media can be circulated back from the return to the supply and feed back into the manifold 310 (such as in a closed loop). In other embodiments, at least some of the media can be disposed of after exiting the outlet port 305*b* and not circulated back into the supply.

At the same time, electrical current can be received by the electrical connection 110*a* and transmitted through the first terminal 105*a*. The electrical current is transmitted from the first terminal 105*a* through each of the resistor elements 115, generating heat via the resistor elements 115. The media traveling through the media channel 130 makes direct contact on at least two surfaces of each of the resistor elements 115, thereby dissipating heat from the resistor elements 115. The electrical current is subsequently transmitted from the resistor elements 115 to the second terminal 105*b* and the second electrical connection 110*b*.

Although FIGS. 3 through 5 illustrate examples of a power resistor system 300, various changes may be made to FIGS. 3 through 5. For example, the makeup and arrangement of the power resistor system 300 are for illustration only. Components could be added, omitted, combined, or placed in any other configuration according to particular needs.

Figure 6:
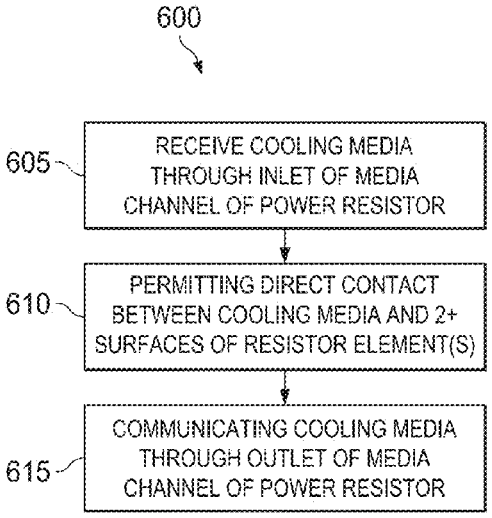
FIG. 6 illustrates an example method implemented using a power resistor according to this disclosure.

FIG. 6 illustrates an example method 600 implemented using a power resistor according to this disclosure. The method 600 may be performed using one or more of the systems shown in FIGS. 1 through 5. However, the method 600 could be used with any other suitable system.

At step 605, a media channel of a power resistor receives cooling media through an inlet. The media channel can be located between a first electrical terminal and a second electrical terminal of the power resistor.

At step 610, the power resistor permits direct contact between the received cooling media and at least a first surface and a second surface of one or more resistor elements of the power resistor. Each resistor element is connected to at least the first electrical terminal and the second electrical terminal. When multiple resistor elements are connected to at least the first electrical terminal and the second electrical terminal, the power resistor permits direct contact between the cooling media and at least a first surface and a second surface of each resistor element. Multiple resistor elements can be connected to be electrically in parallel, thermally in parallel, electrically in series, or thermally in series.

At step 615, the media channel of the power resistor communicates the cooling media to an outlet of the media channel after permitting the direct contact between the media and the resistor element(s) of the power resistor. This transports heat out of the power resistor and away from the resistor element(s).

Although FIG. 6 illustrates one example of a method 600 using a power resistor, various changes may be made to FIG. 6. For example, while shown as a series of steps, various steps shown in FIG. 6 could overlap, occur in parallel or series, occur in a different order, or occur multiple times. Moreover, some steps could be combined.

Note that any suitable cooling media could be used with the power resistors and the power resistor systems described above. For example, the cooling media could include one or more liquids, gases, or solids. Example solids could include a fine powder or particulate slurry. The cooling media is used primarily for heat absorption and subsequent transport away from the resistor elements, and the cooling media can be replenished by a continuous or discontinuous flow of the media, such as by using a pump or other mechanism.

It may be advantageous to set forth definitions of certain words and phrases used throughout this patent document. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of:

A, B, and C" includes any of the following combinations: A, B, C, A and B, A and C, B and C, and A and B and C.

Modifications, additions, or omissions may be made to the systems, apparatuses, and methods described herein without departing from the scope of the invention. The components of the systems and apparatuses may be integrated or separated. Moreover, the operations of the systems and apparatuses may be performed by more, fewer, or other components. The methods may include more, fewer, or other steps. Additionally, steps may be performed in any suitable order. As used in this document, "each" refers to each member of a set or each member of a subset of a set.

To aid the Patent Office, and any readers of any patent issued on this application in interpreting the claims appended hereto, applicants wish to note that they do not intend any of the appended claims or claim elements to invoke paragraph 6 of 35 U.S.C. Section 112 as it exists on the date of filing hereof unless the words "means for" or "step for" are explicitly used in the particular claim.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A resistor comprising:

first and second electrical terminals that are spaced apart from each other, each electrical terminal comprising a plurality of connection points;

a first substantially planar resistor element having a first end connected to a first one of the connection points of the first electrical terminal and a second end connected to a first one of the connection points of the second electrical terminal, the first resistor element configured to directly contact one or more cooling media on at least two surfaces of the first resistor element in order to transfer heat away from the first resistor element; and a second substantially planar resistor element having a first end connected to a second one of the connection points of the first electrical terminal and a second end connected to a second one of the connection points of the second electrical terminal, the second resistor element configured to directly contact the one or more cooling media on at least two surfaces of the second resistor element in order to transfer heat away from the second resistor element.

2. The resistor of claim 1, wherein at least the first electrical terminal and the second electrical terminal form a media channel configured to communicate the one or more cooling media across the first and second resistor elements.

3. The resistor of claim 1, wherein:

the at least two surfaces of the first resistor element are disposed on opposing sides of the first resistor element; and the at least two surfaces of the second resistor element are disposed on opposing sides of the second resistor element.

4. The resistor of claim 1, wherein:

when a voltage drop occurs across the first resistor element, the first resistor element is configured to transfer heat to the one or more cooling media via the at least two surfaces of the first resistor element; and when a voltage drop occurs across the second resistor element, the second resistor element is configured to transfer heat to the one or more cooling media via the at least two surfaces of the second resistor element.

5. The resistor of claim 1, wherein:

an area of each of the at least two surfaces of the first resistor element is greater than an area of each remaining surface of the first resistor element; and an area of each of the at least two surfaces of the second resistor element is greater than an area of each remaining surface of the second resistor element.

6. The resistor of claim 1, wherein each of the at least two surfaces of the first resistor element and each of the at least two surfaces of the second resistor element comprises a ruthenium (IV) oxide ($RuO_2$) film.

7. The resistor of claim 1, wherein:

the at least two surfaces of the first resistor element are separated by a first substrate; and the at least two surfaces of the second resistor element are separated by a second substrate.

8. A resistor system comprising:

a resistor; and a manifold configured to house the resistor and provide one or more cooling media for communication through the resistor, wherein the resistor comprises:

first and second electrical terminals that are spaced apart from each other, each electrical terminal comprising a plurality of connection points;

a first substantially planar resistor element having a first end connected to a first one of the connection points of the first electrical terminal and a second end connected to a first one of the connection points of the second electrical terminal, the first resistor element configured to directly contact the one or more cooling media on at least two surfaces of the first resistor element in order to transfer heat away from the first resistor element; and a second substantially planar resistor element having a first end connected to a second one of the connection points of the first electrical terminal and a second end connected to a second one of the connection points of the second electrical terminal, the second resistor element configured to directly contact the one or more cooling media on at least two surfaces of the second resistor element in order to transfer heat away from the second resistor element.

9. The resistor system of claim 8, wherein the manifold comprises:

a first cavity configured to receive the one or more cooling media from an inlet port; and a second cavity configured to transfer the one or more cooling media to an outlet port.

10. The resistor system of claim 9, wherein at least the first electrical terminal and the second electrical terminal form a media channel configured to receive the one or more cooling media from the first cavity, permit communication of the one or more cooling media across the first and second resistor elements, and provide the one or more cooling media to the second cavity.

11. The resistor system of claim 8, wherein:

the at least two surfaces of the first resistor element are disposed on opposing sides of the first resistor element; and the at least two surfaces of the second resistor element are disposed on opposing sides of the second resistor element.

12. The resistor system of claim 8, wherein:

when a voltage drop occurs across the first resistor element, the first resistor element is configured to transfer heat to the one or more cooling media via the at least two surfaces of the first resistor element; and when a voltage drop occurs across the second resistor element, the second resistor element is configured to transfer heat to the one or more cooling media via the at least two surfaces of the second resistor element.

13. The resistor system of claim 8, wherein:

an area of each of the at least two surfaces of the first resistor element is greater than an area of each remaining surface of the first resistor element; and an area of each of the at least two surfaces of the second resistor element is greater than an area of each remaining surface of the second resistor element.

14. The resistor system of claim 8, wherein each of the at least two surfaces of the first resistor element and each of the at least two surfaces of the second resistor element comprises a ruthenium (IV) oxide ($RuO_2$) film.

15. The resistor system of claim 8, wherein:

the at least two surfaces of the first resistor element are separated by a first substrate; and the at least two surfaces of the second resistor element are separated by a second substrate.

16. A method comprising:

receiving one or more cooling media by an inlet of a channel of a resistor, the channel between a first electrical terminal and a second electrical terminal of the resistor, the first and second electrical terminals spaced apart from each other, each electrical terminal comprising a plurality of connection points;

permitting direct contact between the one or more cooling media and at least a first surface and a second surface of a first substantially planar resistor element of the resistor, the first resistor element having a first end connected to a first one of the connection points of the first electrical terminal and a second end connected to a first one of the connection points of the second electrical terminal;

permitting direct contact between the one or more cooling media and at least a first surface and a second surface of a second substantially planar resistor element of the resistor, the second resistor element having a first end connected to a second one of the connection points of the first electrical terminal and a second end connected to a second one of the connection points of the second electrical terminal; and communicating the one or more cooling media to an outlet of the channel of the resistor after permitting the direct contact between (i) the one or more cooling media and at least the first surface and the second surface of the first resistor element of the resistor and (ii) the one or more cooling media and at least the first surface and the second surface of the second resistor element of the resistor.

17. The method of claim 16, wherein:

the first and second surfaces of the first resistor element are disposed on opposing sides of the first resistor element; and the first and second surfaces of the second resistor element are disposed on opposing sides of the second resistor element.

18. The method of claim 16, wherein:

an area of each the first and second surfaces of the first resistor element is greater than an area of each remaining surface of the first resistor element; and an area of each of the first and second surfaces of the second resistor element is greater than an area of each remaining surface of the second resistor element.

19. The method of claim 16, wherein each of the first and second surfaces of the first resistor element and each of the first and second surfaces of the second resistor element comprises a ruthenium (IV) oxide ($RuO_2$) film.

20. The method of claim 16, wherein:

the first and second surfaces of the first resistor element are separated by a first substrate; and the first and second surfaces of the second resistor element are separated by a second substrate.

* * * * *